United States Patent [19]

Iwagaki et al.

[11] Patent Number: 4,840,882

[45] Date of Patent: Jun. 20, 1989

[54] HEAT DEVELOPABLE COLOR LIGHT-SENSITIVE MATERIAL

[75] Inventors: Masaru Iwagaki; Takashi Sasaki; Tawara Kumamura; Fumio Ishii; Kunihiro Koshizuka, all of Tokyo, Japan

[73] Assignee: Konishiroku Photo Industry Co., Ltd., Tokyo, Japan

[21] Appl. No.: 240,361

[22] Filed: Aug. 31, 1988

Related U.S. Application Data

[63] Continuation of Ser. No. 898,849, Aug. 19, 1986, abandoned, which is a continuation of Ser. No. 674,569, Nov. 26, 1984, abandoned.

[30] Foreign Application Priority Data

Dec. 2, 1983 [JP] Japan ..... 58-226759

[51] Int. Cl.[4] ..... G03C 5/54; G03C 1/46

[52] U.S. Cl. ..... 430/505; 430/201; 430/203; 430/217; 430/619

[58] Field of Search ..... 430/203, 351, 212, 217, 430/617, 619, 201, 505

[56] References Cited

U.S. PATENT DOCUMENTS

| | | | |
|---|---|---|---|
| 4,187,108 | 2/1980 | Willis | 430/203 |
| 4,430,415 | 2/1984 | Aono et al. | 430/203 |
| 4,483,914 | 11/1984 | Naito et al. | 430/203 |
| 4,499,172 | 2/1985 | Hirai et al. | 430/203 |
| 4,499,180 | 2/1985 | Hirai et al. | 430/203 |
| 4,500,627 | 2/1985 | Naito et al. | 430/203 |
| 4,584,267 | 4/1986 | Masukowa et al. | 430/203 |

OTHER PUBLICATIONS

"Heat Developable Photosensitive Material", Abstract from JP1-18942, 1/1986, Sawada.

Research Disclosure No., 23525, Nov. 1983, pp. 362-364.

Research Disclosure No. 17643, Dec. 1978, pp. 22-31, Eastman Kodak.

James, "The Theory of the Photographic Process", 4th Edition, 1977, Macmillan, pp. 77-84.

*Primary Examiner*—Richard L. Schilling

*Attorney, Agent, or Firm*—Frishauf, Holtz, Goodman & Woodward

[57] ABSTRACT

In a heat-developable color light-sensitive material comprising a support having thereon at least two light-sensitive layers each comprising a light-sensitive silver halide, organic silver salt, dye-donating material capable of releasing or forming a diffusible dye by heat development, reducing agent, and hydrophilic binder, said at least two light-sensitive layers differing from each other in the color sensitivity of said light-sensitive silver halide and in the hue of said diffusible dye, said heat-developable color light-sensitive material, wherein at least one of said light-sensitive layer(s) containing said dye-donating materials are hardened with a hardening agent for said hydrophilic binder. The foregoing heat-developable color light-sensitive material prevents diffusion of the dye-donating material and reduces or prevents the color-crossover phenomenon. Transferability of the dye is also improved as is scratch resistance of the photographic component layers.

18 Claims, No Drawings

HEAT DEVELOPABLE COLOR LIGHT-SENSITIVE MATERIAL

This application is a continuation of application Ser. No. 898,849, filed Aug. 19, 1986, which is a continuation of Ser. No. 674,569 filed Nov. 26, 1984, abandoned.

BACKGROUND OF THE INVENTION

1. Field of the Invention

The present invention relates to a heat-developable color light-sensitive material, and more particularly to a multilayer-type heat-developable color diffusion transfer light-sensitive material which is improved in that a color crossover phenomenon is prevented.

2. Description of the Prior Art

The conventionally known light-sensitive silver halideusing color photographic process is superior in the speed, gradation and image preservability to other color photographic processes, and has been most extensively been used to date. The process, however, has many such problems that the process itself is time-consuming and laborious in respect that it needs all wet developing, bleaching, fixing and washing steps; there is the anxiety that the use of processing chemicals in these steps can be harmful to the human body or an pollute the processing room or operator's body; and the disposal of the wastes of these processing chemicals is laborious and costly.

For this reason, the development of a method for the formation of a color image in a dry process has long been awaited.

Heat-developable black-and-white light-sensitive materials are of the prior art, which are found in, e.g., Japanese Patent Examined Publication Nos. 4921/1968 and 4924/1968, which disclose light-sensitive materials comprising an organic silver salt, silver halide and developing agent. Further, there are also known many heat-developable-type color light-sensitive materials which apply the heat-developable black-and-white light-sensitive material.

For example, U.S. Pat. Nos. 3,531,286, 3,761,270 and 3,764,328; Research Disclosure Nos. 15108, 15127, 12044 and 16479 describe those heat-developable light-sensitive materials comprising photographic couplers and color developing agent; U.S. Pat. No. 3,180,731; Research Disclosure Nos. 13443 and 14347 describe those using leuco dyes; U.S. Pat. Nos. 4,235,957; Research Disclosure Nos. 14433, 14448, 15227, 15776, 18137 and 19419 describe those applying the silver-dye bleach process; and U.S. Pat. Nos. 4,124,398, 4,124,387 and 4,123,273 describe methods for heat-bleaching developable light-sensitive materials.

However, these proposed heat-developable color light-sensitive materials are disadvantageous in respect that the black-and-white silver image simultaneously formed on them is difficult or quite impossible to be bleached or fixed, or even though possible, required to be subjected to an additional wet processing. Accordingly, any of these proposals can hardly provide a clear color image or would require troublesome post-treatments, so that no satisfactory one is found among these proposals.

On the other hand, heat-developable color light-sensitive materials that form a color image by the transfer of the diffusible dye released by heat development are disclosed in Japanese Patent Publication Open to Public Inspection (hereinafter referred to as Japanese Patent O.P.I. Publication) Nos. 12431/1984, 124338/1984, and in U.S. Pat. Nos. 4,463,079, 4,474,867 and 4,430,415. European Pat. Nos. 66,282, 67,455 and 76,492.

These proposals are of forming a color image by transfering onto an image-receiving layer the diffusible dye released by the heat-developing reaction of an organic silver salt with a dye-donating material having in the same molecule thereof the diffusible dye: These are what we call herein the "dye-releasing type."

Meantime, the proposals disclosed in Japanese Patent O.P.I. Publication Nos. 124339/1984 and 159159/1984 are of providing a color image by transfering onto an image-receiving layer the diffusible dye formed by the reaction of a colorless or light-color dye-donator with the oxidized product of a color developing agent, produced by the heat-developing reaction of an organic silver salt: These are what we call herein the "dye-forming type."

Where a color image is to be formed on an image-receiving layer by the diffusion transfer of a dye by heat without wet processing, whether the dye-releasing type or dye-forming type, there arises the problem that a "color crossover" phenomenon occurs due to the dye donator's diffusion into between the layers at the time of heat development.

SUMMARY OF THE INVENTION

Object of the Invention

It is therefore an object of the present invention to provide a heat-developable color light-sensitive material which is prevented from trouble due to color crossover.

As a result of our continued investigation, it has now been found that the above object is accomplished by the following heat-developable color light-sensitive material: In a heat-developable color light-sensitive material comprising a support having thereon at least two light-sensitive layers each containing a light-sensitive silver halide, organic silver salt, dye-donating material capable of releasing or forming a diffusible dye by heat development, reducing agent and hydrophilic binder, the said at least two light-sensitive layers being different in the spectral sensitivity of the light-sensitive silver halide and hue of the dye from each other, the said heat-developable color light-sensitive material, wherein at least one of the above layers containing the dye donating material contains a hardening agent for the hydrophilic binder to harden the hydrophilic binder. Thus the present invention has been completed.

DETAILED DESCRIPTION OF THE INVENTION

The present invention will be illustrated in detail below:

As the hardening agent for the hydrophilic binder of this invention, hardeners for gelatin are usually suitably used, which include, e.g., inorganic salts such as chrome alum, chromium acetate, etc.; aldehydes such as formalin, glyoxal, glutaraldehyde, etc.; N-methylols such as dimethylolurea, methyloldimethylhydantoin, etc.; ketones such as 2,3-butanedione, 1,2-cyclopentanedione, etc.; carbamic acids such as dimethylcarbamoylpyridinium chloride, etc.; sulfonates such as trimethylene-bis(methanesulfonate), etc.; sulfonyl halides such as ethylene-bis(sulfonyl fluoride), etc.; active halogenated compounds such as bis(2-chloroethyl)urea, 2,4-dichloro-6-hydroxy-s-triazine, etc.; mucohalogenic acids such as mucochloric acid, mucobromic acid, mucophenoxychloric aicd, etc.; epoxy compounds such as diglycidyl ether, etc.; aziridines such as triethylmelamine, hexamethylene-bis(aziridinylcarbamide), etc., 1-ethyl-3-(3'-dimethylaminopropyl)carbodiimide hydrochloride; active olefins such as 1,3-bis(acryloyl)urea, divinyl ketone, diacrylamide, 1,3,5-triacryloylhexahydro-s-triazine-bis(vinylsulfonyl)ether, etc.; functional group-having high-molecular hardeners such as partial ester of maleic acid with polyvinyl alcohol, glycidylacrylate copolymers, etc.; and the like.

The above hardening agents are described in Japanese Patent O.P.I. Publication Nos. 78788/1976, 139689/1978 and 27135/1981; U.S. Pat. Nos. 3,843,372, 1,870,354, 2,080,019, 2,726,162, 2,870,013, 2,983,611, 2,992,109, 3,047,394, 3,057,723, 3,103,437, 3,321,313, 3,325,287, 3,362,827 and 3,543,292; British Pat. Nos. 676,628, 825,544 and 1,270,578; West German Patent Nos. 672,153 and 1,090,427; Japanese Patent Examined Publication Nos. 7133/1959 and 1872/1971; and Research Disclosure vol. 176, p. 26 Dec. 1978).

The particularly preferred hardening agents are those compounds having in the molecules thereof at least two vinyl-sulfonyl groups, which are described in U.S. Pat. Nos. 3,868,257, 4,088,495, 4,134,765, 4,137,082 and 4,161,407; Japanese Patent O.P.I. Publication Nos. 116154/1974, 118746/1974, 57257/1978, 66960/1978 and 50535/1983; and Japanese Patent Examined Publication Nos. 24259/1972 and 13563/1974.

The preferred compounds have the following Formula (I):

$$(CH_2{=}CH{-}SO_2)_nR(n) \qquad \text{Formula (I)}$$

wherein, n is an integer of not less than two and preferably from two to six; and R(n) is an n-valent coupling group and is allowed to have the substituents including, for example, a halogen, a hydroxy group, a sulfo group, a heterocyclic group such as morpholino group, piperidino group, piperazino group, pyrolidinyl group and the like, an aromatic group such as phenyl group, p-carboxyphenyl group, naphthyl group and the like. The R(n) groups are also allowed to contain such a di- or trivalent group as an ether, thioether, amide, phenylene,

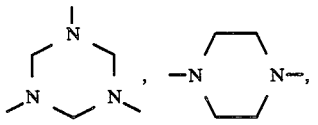

carbonyl, imino, sulfonyl or sulfonamide group, and the like.

Examples of these compounds are enumerated below:

Exemplified Compounds:

$H_2C{=}CHSO_2CH_2SO_2CH{=}CH_2$ (1)

$H_2C{=}CHSO_2CH_2CH_2SO_2CH{=}CH_2$ (2)

$H_2C{=}CHSO_2CH_2CH_2CH_2SO_2CH{=}CH_2$ (3)

$H_2C{=}CHSO_2CH_2OCH_2SO_2CH{=}CH_2$ (4)

$H_2C{=}CHSO_2CH_2CH_2OCH_2CH_2SO_2CH{=}CH_2$ (5)

$CH_2{=}CHSO_2CH_2CH(OH)CH_2SO_2CH{=}CH_2$ (6)

-continued

Exemplified Compounds:

$CH_2{=}CHSO_2CH_2CH(OH)CH_2CH(OH)CH_2SO_2CH{=}CH_2$ (7)

$CH_2{=}CHSO_2CH_2CH(OH)CH_2OCH_2CH(OH)CH_2SO_2CH{=}CH_2$ (8)

$CH_2{=}CHSO_2CH_2CONHNHCOCH_2SO_2CH{=}CH_2$ (9)

$CH_2{=}CHSO_2CH_2CONHCH_2NHCOCH_2SO_2CH{=}CH_2$ (10)

$CH_2{=}CHSO_2CH_2CONHCH_2CH_2NHCOCH_2SO_2CH{=}CH_2$ (11)

$CH_2{=}CHSO_2CH_2CONHCH_2CH_2CH_2NHCOCH_2SO_2CH{=}CH_2$ (12)

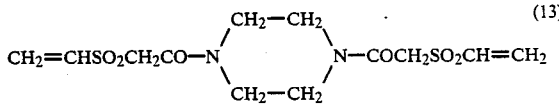

(13)

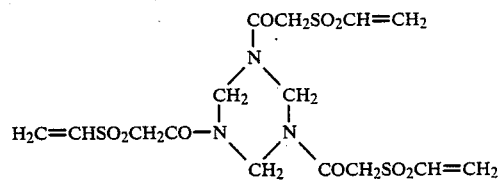

(14)

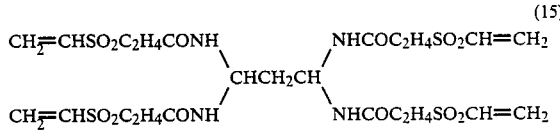

(15)

(16)

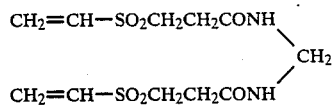

(17)

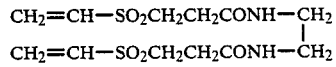

(18)

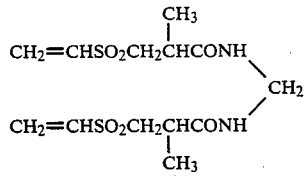

(19)

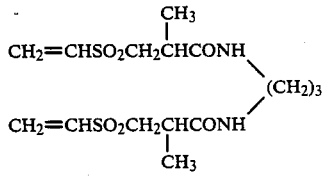

(20)

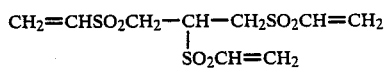

(21)

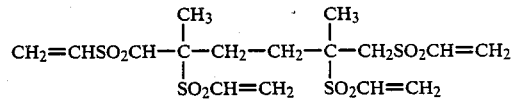

(22)

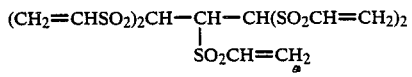

-continued

Exemplified Compounds:

(23)

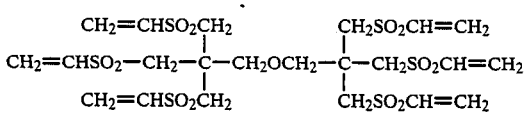

$(CH_2{=}CHSO_2CH_2)_3C{-}CH_2SO_2CH_2CH_2SCH_2COOH$ (24)

$(CH_2{=}CHSO_2CH_2)_3C{-}CH_2SO_2CH_2CH_2NHCH_2CH_2SO_3H$ (25)

(26)

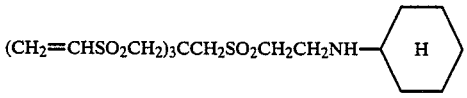

$[(CH_2{=}CHSO_2CH_2)_3CCH_2SO_2CH_2CH_2SCH_2]_2CO$ (27)

(28)

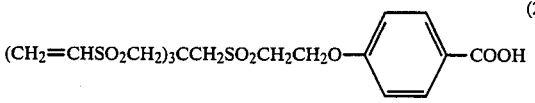

(29)

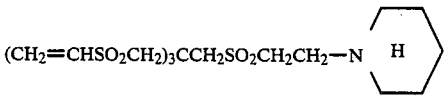

(30)

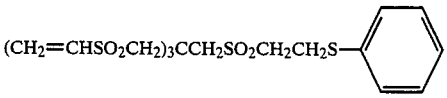

$C[CH_2{-}SO_2{-}CH{=}CH_2]_4$ (31)

In the present invention, the above hardening agents may be used alone or in combination of two or more of them.

The hardening agent used in this invention may be added in a quantity of from 0.1 to 500 mg, and preferably from 1 to 100 mg per gram of the hydrophilic binder in order to reduce the color-crossover effectively.

In the present invention, the hardening agent may be incorporated into all or part of the layers containing a dyedonating material; for example, the hardening agent may be incorporated into either the light-sensitive layer(s) (all the layers or a single layer) containing a dye-donating material or non-light-sensitive interlayers and protective layer.

And, in the present invention, the hardening agent may be used along with a hardening accelerator which includes polyhydroxybenzenes, alkaline metal salts of organic acids, and the like. Further, the hardening agent of this invention, as is disclosed in U.S. Pat. No. 4,142,897, may be used in the form of a partial reaction product with a hydrophilic material, and, as is disclosed in Japanese Patent O.P.I. Publication No. 142330/1980, may also be used with the addition of a protective colloidal material thereto.

The binder for the heat-developable color light-sensitive material of the present invention is a hydrophilic binder. The hydrophilic binder in the present invention is one that is soluble in water or in a mixture liquid of water with an organic solvent (arbitrarily miscible with water). Materials usable as the hydrophilic binder include, for example, proteins such as gelatin, gelatin derivatives, etc.; cellulose derivatives; polysaccharides such as dextran; natural materials such as gum arabic; and such useful polymers as polyvinyl acetals (preferably those of an acetalation degree of not more than 20%, such as polyvinylbutyral), polyacrylamides, polyvinylpyrolidones, ethyl celluloses, polyvinyl alcohols (preferably those of a saponification degree of not less than 75%), and the like. In the present invention, gelatin-containing binder materials may be suitably used; particularly gelatin-polyvinylpyrolidone-type and gelatin-polyvinyl-alcohol-type binder materials are advantageously usable. The use quantity of any of these binder materials per part by weight of the organic silver salt in each light-sensitive layer is from 1/10 to 10 parts by weight, and preferably from $\frac{1}{4}$ to 4 parts by weight.

The dye-donating material used in this invention is a compound capable of releasing or forming a diffusible dye as a result of heat development. The term "diffusible" used herein means the movable nature of the released or formed dye from the foregoing dye-donating material-containing layer to the adjacent layer having superposed relation therewith. The embodiment of this movement of the dye includes the case where, when the formed dye itself is a diffusible compound, the foregoing movement is effected by this diffusibility; the case where the formed dye is dissolved into a solvent therefor or thermally dissolved by and into a heated solvent thereby to be moved; and further the case where the formed dye itself is sublimable, so that it can be moved into the other layer.

The term "sublimable" used herein means not only the commonly interpreted nature that a solid substance is converted into a vapor without through liquid form but also the nature that a solid material is fused to become a liquid, and further converted into a vapor.

The dye-donating material usable in this invention is desirable to be a dye-forming-type compound which includes preferably those having the following general formula:

A—B Formula (I)

wherein A represents a hydrophobic group-having coupler residue, preferably example is such as one having no hydrophilic group such as sulfo, carboxyl or sulfonamido group; and B represents a group that can be split off from the coupler residue during a coupling reaction, the group having sulfo, carboxyl or sulfamoyl group, or a group substituted by any of these hydrophilic groups. The particularly preferred compounds having Formula (I) are those couplers capable of forming a sublimable or volatile dye by the reaction thereof with the oxidized product of a color developing agent, the couplers being disclosed in our proposed Japanese Patent O.P.I. Publication No. 124339/1984 and in Japanese Patent Application No. 33364/1983.

These couplers are ones producing a hydrophobic and diffusible dye by the coupling reaction thereof with the oxidized product of a color developing agent formed in heat development, and include those compounds having the following Formulas (II) to (VII):

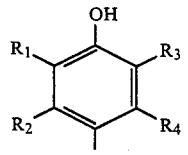

Formula (II)

-continued

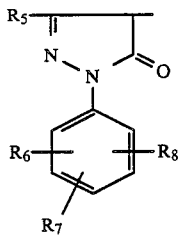

(Formula (III))

$R_9COCHCOR_{10}$

Formula (IV)

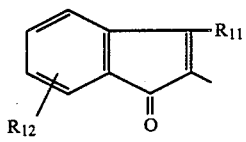

Formula (V)

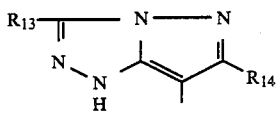

Formula (VI)

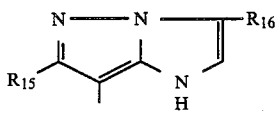

Formula (VII)

wherein $R_1$, $R_2$, $R_3$ and $R_4$ each is a hydrogen atom, a halogen atom (preferably chlorine, bromine or iodine), a substituted or nonsubstituted alkyl group (preferably an alkyl group having from 1 to 24 carbon atoms, such as methyl, ethyl, butyl, t-octyl, n-dodecyl, n-pentadecyl, cyclohexyl, etc., and may also be an aryl-substituted, e.g., phenyl-substituted alkyl group such as benzyl or phenethyl), a substituted or nonsubstituted aryl group (e.g., phenyl, naphthyl, 4-chlorophenyl tolyl or mesityl), an acyl group (e.g., acetyl, tetradecanoyl, pivaloyl, substituted or nonsubstituted benzoyl such as 3-methylbenzoyl and 4-methoxybenzoyl groups), a substituted or nonsubstituted alkyloxycarbonyl group (e.g., methoxycarbonyl, benzyloxycarbonyl), a substituted or nonsubstituted aryloxycarbonyl group (e.g., phenoxycarbonyl, p-tolyloxycarbonyl, α-naphthoxycarbonyl), a substituted or nonsubstituted alkylsulfonyl group (e.g., methylsulfonyl), a substituted or nonsubstituted arylsulfonyl group (e.g., phenylsulfonyl), a carbamoyl group (e.g., substituted or nonsubstituted alkylcarbamoyl such as N,N-dimethylcarbamoyl, methylcarbamoyl, butylcarbamoyl, tetradecylcarbamoyl, N-methyl-N-dodecylcarbamoyl; substituted or nonsubstituted phenoxyalkylcarbamoyl such as 2,4-di-t-phenoxybutylcarbamoyl; substituted or nonsubstituted phenylcarbamoyl such as 2-dodecyloxyphenylcarbamoyl 2-chlorophenylcarbamoyl, 3-methylphenylcarbamoyl or the like), a substituted or nonsubstituted acylamino group (e.g., n-butylamido, laurylamido acetamido, i-propylamido and β-methoxyethylamido, substituted or nonsubstituted β-phenoxyethylamido such as β-(2,4-dimethylphenoxy)ethylamido, phenoxyacetamido, substituted or nonsubstituted benzamido, such as 4-methylbenzamido, 2,4-dichlorobenzamido, methanesulfonamidoethylamido, β-methoxyethylamido, an substituted or nonsubstituted alkoxy group (preferably an alkoxy group having from 1 to 18 carbon atoms, such as methoxy, ethoxy, octadecyloxy), a sulfamoyl group (e.g., methylsulfamoyl, n-dodecylsulfamoyl, substituted or nonsubstituted phenylsulfamoyl, 2-methylphenylsulfamoyl, and 4-methoxyphenylsulfamoyl, such as dodecylphenylsulfamoyl), a sulfonylamino group (e.g., methylsulfonylamino, tolylsulfonylamino), or a hydroxyl group; the $R_1$ and $R_2$ being allowed to combine with each other to form a saturated or unsaturated 5- to 6-member cyclic ring; $R_5$ represents a substituted or nonsubstituted alkyl group (preferably an alkyl group having from 1 to 24 carbon atoms, such as methyl, butyl, heptadecyl), a substituted or nonsubstituted alkoxy group (preferably an alkoxy group having from 1 to 18 carbon atoms, such as methoxy, ethoxy, octadecyloxy), a substituted or nonsubstituted arylamino group (e.g., anilino or anilino substituted with such a substituent as a halogen, alkyl, amido or imido such as 2-chloronilino, 0-toluidino, 4-acetamidophenylamino, 3-(methylaminophenyl)amino and 4-nitronilino), a substituted or nonsubstituted alkylamido group (e.g., laurylamido, acetamido, i-propylamido, β-methoxyethylamido, or substituted or nonsubstituted phenoxyacetamido, such as 4-methylphenoxyacetamido and 2-chlorophenoxyacetamide, phenoxybutaneamido), or a substituted or nonsubstituted arylamido group (e.g., benzamido or benzamido substituted with a halogen, alkyl, alkoxy or amido); $R_6$, $R_7$ and $R_8$ each is a hydrogen atom, a halogen atom (preferably chlorine, bromide or iodine), a substituted or nonsubstituted alkyl group (preferably an alkyl group having from 1 to 2 carbon atoms, such as methyl, ethyl), a substituted or nonsubstituted alkylamido group (e.g., laurylamido, acetamido, i-propylamido, or a substituted or nonsubstituted phenoxyalkylamido such as an alkyl substituted phenoxyacetamido e.g. 2-methylphenoxyacetamide), or a substituted or nonsubstituted arylamido group (e.g., benzoylamido 2-chlorobenzamide, or 4-methylbenzamido); $R_9$ is a substituted or nonsubstituted alkyl group (preferably an alkyl group having from 1 to 8 carbon atoms, such as methyl, butyl, octyl), or a substituted or nonsubstituted aryl group (e.g., phenyl, 2-chlorophenyl, 3,5-dimethoxyphenyl, tolyl, methoxyphenyl); $R_{10}$ is a substituted or nonsubstituted arylamino group (e.g., anilino or anilino substituted with a halogen, alkyl, alkoxy, alkylamido, arylamido or imido); and $R_{11}$, $R_{12}$, $R_{13}$, $R_{14}$, $R_{15}$ and $R_{16}$ each is as defined in the previously mentioned $R_1$ and $R_2$.

In Formula (I), B represents a sulfo group, a carboxyl group, a subfamoyl group or a group represented by -J-Y, wherein J is a divalent linkage group, and Y is an alkyl or aryl group substituted with a water-soluble group. Examples of the divalent linkage group represented by J include —O—, —S—, $$-\underset{\underset{O}{\|}}{OCO}-,\quad -\underset{\underset{O}{\|}}{OC}-NH-,\quad -\underset{\underset{O}{\|}}{OC}-,$$

—N=N—, —NHCO—, $-NHSO_2-$, $-O-SO_2-$, etc. The alkyl or aryl group represented by Y includes preferably alkyls or aryls substituted with a sulfo, carboxyl or sulfamoyl group.

The alkyl groups or the aryl groups represented by Y may further be substituted with other substituents than the water-soluble groups. The substituents include, for example, carbamoyl, sulfamoyl, carboxyamido, sulfamido, carbalkoxy, alkoxy, amino and hydroxylic groups and a halogen. These substituents may further be substituted with an alkyl or aryl group. The total number of carbon atoms of the substituents each represented by Y is from 1 to 40 and preferably from 1 to 22.

The preferable compounds within these above-described compounds represented by Formulas (II) to (VIII) have in the active-site substituent thereof a sulfo, carboxyl or sulfamoyl group in order to immobilize the whole coupler molecules against heat inside the coupler-containing layer, and, further, are desirable to have an alkyl group having not less than 8 carbon atoms or an aryl group having an alkyl group having not less than 4 carbon atoms inside the coupler molecules (either inside the coupler residue represented by the foregoing A or inside the active-site substituent represented by B, but the above alkyl or alkyl-substituted aryl group is preferred to be inside the active-site substituent for the formation of a diffusible dye. On the other hand, even in the case where the group is inside the foregoing coupler residue, the transfer of an image by a heated solvent can be effected adequately), and the hydrophilic active-site substituent is split off due to the coupling reaction with the oxidized product of a color developing agent to thereby form a hydrophobic dye.

The following are typical examples of the dye-forming-type dye-donating material having Formula (I), used in the present invention, but the invention is not limited by the examples.

Exemplified Compounds:

(1)

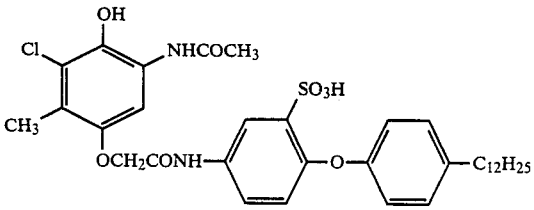

(2)

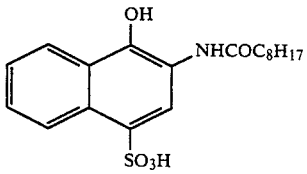

(3)

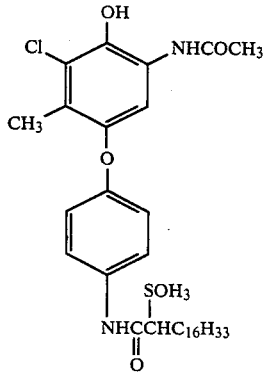

(4)

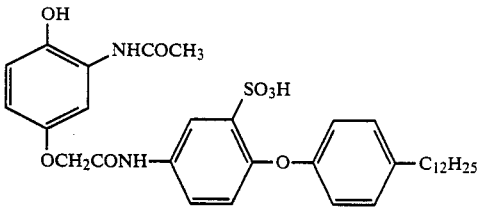

(5)

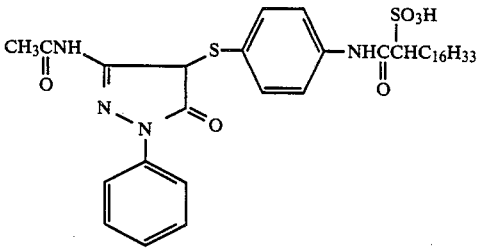

(6)

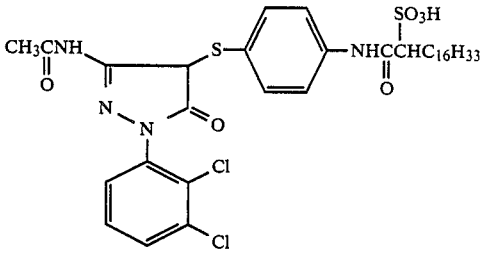

(7)

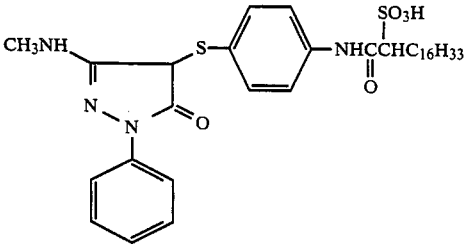

-continued

Exemplified Compounds:

(8)

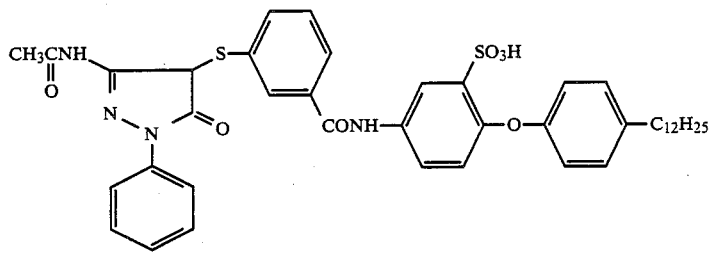

(9)

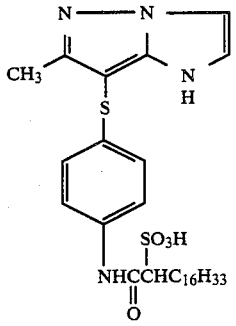

(10)

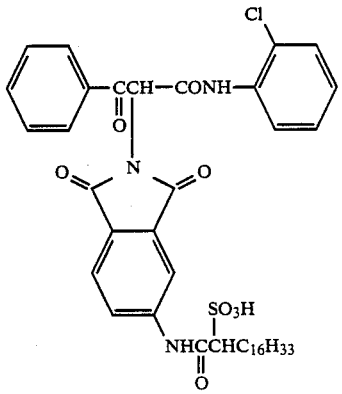

(11)

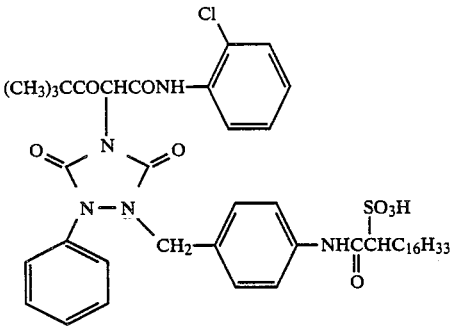

(12)

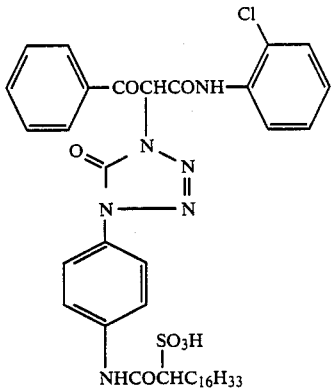

The use quantity of the above dye-donating materials used in this invention, although different according to the composition of the heat-developable light-sensitive material used, coating conditions, method for processing, and the like, is in the range of from about 0.01 to 10 moles, and preferably from about 0.1 to 2.0 moles per mole of the organic silver salt used.

The incorporation of the dye-donating material of this invention into the heat-developable light-sensitive layer of the heat-developable color light-sensitive material may be carried out by dissolving the dye-donating material into a highboiling solvent as is described in, e.g., U.S. Pat. No. 2,322,027 for the dispersion of couplers. Further, in the above dispersing method, a low-boiling solvent may, if necessary, be used in combination with the high-boiling solvent to dissolve the dye-donating material thereinto, and the solution may be then incorporated in the heat-developable light-sensitive layer.

The above high-boiling solvent includes, e.g., n-butyl phthalate, tricresyl phosphate, dioctyl phthalate, n-nonylphenol, and the like, and the low-boiling solvent includes, e.g., methyl acetate, butyl propionate, cyclohexanol, diethyleneglycol monoacetate, and the like. These solvents may be used alone or in a mixture. The dye-donating material thus dissolved into the solvent is mixed into an aqueous solution of a hydrophilic binder such as gelatin, containing an anionic surface active agent such as alkylbenzenesulfonic acid or alkylnaphthalenesulfonic acid and/or a nonionic surface active agent such as sorbitan monolaurate, and is then emulsifiedly dispersed by means of a colloid mill or ultrasonic disperser, and the dispersed liquid may be then incorporated into the heat-developing light-sensitive layer.

Any of the above-mentioned boiling solvents is used in a quantity necessary to dissolve the dye-donating material completely, and preferably in the quantity range of from 0.05 to 100 parts by weight per part by weight of the dye-donating material.

Aside from the above, there is a suitable dispersion method called "Fischer's dispersion." The Fischer's dispersion is such that a dye-donating material having both hydrophilic and hydrophobic components in the same molecules thereof is dissolved and dispersed into an aqueous alkaline solution. The dissolution and dispersion may be effected by the air of the addition of an organic solvent compatible with water, heating with stirring (by means of a homogenizer, ultrasonic disperser, or the like), or a surface active agent. As the alkali for the aqueous alkaline solution, inorganic bases or water-compatible organic bases may be used. After being dissolved and dispersed, the dye-donating material liquid may, if necessary, be adjusted with respect to the pH thereof by using a water-compatible organic or inorganic acid as the pH adjusting agent. The preferred surface active agent as the dispersing aid includes anionic and nonionic active agents. Of these, anionic surface active agents are most suitably usable.

The above-mentioned Fischer's dispersion is sometimes also called "Agfa dispersion," which can be referred to those techniques described in British Pat. Nos. 455,556, 465,823 and 298,979.

The heat-developable light-sensitive layer of the present invention contains a light-sensitive silver halide in addition to the foregoing dye-donating material. The light-sensitive silver halide usable in this invention includes silver chloride, silver bromide, silver iodide, silver chlorobromide, silver chloroiodide, silver iodobromide, silver chloroiodobromide, and a mixture of some of these silver halides. The light-sensitive silver halide can be prepared in accordance with any arbitrary prior-art methods such as the single-jet method, double-jet method, and the like, which are well-known to those in the art in the photographic field. In the present invention, however, satisfactory results can be obtained when the silver halide is prepared in usual manner for light-sensitive silver halide emulsions.

The light-sensitive silver halide emulsion of this invention may be chemically sensitized in any arbitrary manner known to those skilled in the art in the photographic field. The chemical sensitization includes gold sensitization, sulfur sensitization, gold-sulfur sensitization, reduction sensitization, and the like.

The silver halide in the above light-sensitive emulsion layer may be either coarse-grained or fine-grained, whose suitable particle size is from about 1.5 μm to about 0.001 μm, and preferably from about 0.5 μm to about 0.01 μm.

The above-prepared light-sensitive silver halide emulsion can be suitably used for the heat-developable light-sensitive layer, the component layer of the light-sensitive material of the present invention.

In the present invention, as another method for the preparation of the light-sensitive silver halide, a light-sensitive silver salt-forming component may be present along with an organic silver salt to thereby form the light-sensitive silver halide as part of the organic silver salt. The light-sensitive silver salt-forming component used in the preparation is, for example, an inorganic halide such as a halide represented by MXn (wherein M is a hydrogen atom, a $NH_4$ group or a metallic atom; X is Cl, Br or I; and n, when the M is a hydrogen atom or $NH_4$ group, is 1, or, when the M is a metallic atom, is the valency thereof, the foregoing metallic atom being lithium, sodium, potassium, rubidium, cecium, copper, gold, beryllium, magnesium, calcium, strontium, barium, zinc, cadmium, mercury, alminum, indium, lanthanum, ruthenium, thalium, germanium, tin, lead, antimony, bismuth, chromium, molybdenum, tungsten, manganese, rhenium, iron, cobalt, nickel, rhodium, palladium, osmium, iridium, platinum, carium, or the like); a halogen-containing metallic complex (such as $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhBr_6$, or the like); an onium halide (e.g., quaternary ammonium halide such as tetramethylammonium bromide, trimethylphenylammonium bromide, cetylethyldimethylammonium bromide, 3-methylthiazolium bromide, trimethylbenzylammonium bromide, etc.; quaternary phosphonium halide such as tetraethylphosphonium halide; tertiary sulfonium halide such as benzylethylmethyl bromide; or the like); a halogenated hydrocarbon (such as iodoform, bromoform-tetrabromohydrocarbon, 2-bromo-2-methylpropane, etc.); a N-halogenated compound (such as N-chlorosuccinic acid imide, N-bromosuccinic acid imide, N-bromophthalic acid imide, N-bromoacetamide, N-iodosuccinic acid imide, N-bromophthalazinone, N-chlorophthalazinone, N-bromoacetanilide, N,N-dibromobenzenesulfonamide, N-bromo-N-methylbenzenesulfonamide, 1,3-dibromo-4,4-dimethylhydantoin, or the like); one of other halogen-containing compounds (such as triphenylmethyl chloride, triphenylmethyl bromide, 2-bromobutyric acid, 2-bromoethanol, etc.); or the like.

These light-sensitive silver halide and light-sensitive silver salt-forming components may be used in combination by various methods. The using quantity of them is from 0.001 mole to 1.0 mole, and preferably from 0.01 mole to 0.3 mole per mole of the organic silver salt used.

The heat-developable color light-sensitive material of this invention, when applied to the three-primary-color process, is of a multi-layer construction comprising blue-, green-and red-sensitive layers; i.e., heat-developable blue-sensitive layer, heat-developable green-sensitive layer and heat-developable red-sensitive layer. These blue-sensitive, green-sensitive and red-sensitive layers can be obtained by the addition of appropriate spectrally sensitizing dyes to the foregoing silver halide emulsion.

It is preferred that everyone of the blue-, green- and red-sensitive layers is to be hardened with a hardener for hardening the hydrophilic binders thereof, and that the light-sensitive layers each adjacent to the blue-, green- and red-sensitive layers contain dye-donating materials capable of releasing or forming the aforementioned dyes having different hues from each other.

Typical examples of the spectrally sensitizing dyes usable in this invention include, for example, cyanines, merocyanines, complex (three- or four-nucleus) cyanines, holopolar cyanines, styryls, hemicyanines, oxonols, and the like. Among cyanine dyes, those having a basic nucleus such as thiazoline, oxazoline, pyrroline, pyridine, oxazole, thiazole, selenazole, imidazole, etc. are suitably usable. Such the nucleus may have an alkyl, alkylene, hydroxyalkyl, sulfoalkyl, carboxyalkyl or aminoalkyl group, or an enamine group capable of forming a condensed carbocyclic or heterocyclic ring, and may also be in either the symmetric or asymmetric form having methine or polymethine chains with an alkyl, phenyl, enamine or heterocyclic substituent.

The merocyanine dye may, in addition to the above basic nucleus, have an acid nucleus such as, for example, a thiohydantoin, rhodanine, oxazolidinedione, thiazolidinedione, barbituric-acid, thiazolinethione, malononitrile or pyrazolone nucleus. These acid nuclei may be further substituted with an alkyl, alkylene, phenyl, carboxyalkyl, sulfoalkyl, hydroxyalkyl, alkoxyalkyl, alkylamine, or heterocyclic group. These dyes may, if necessary, be used in comination. Further, a supersensitizing additive may be combindly used which absorbs no visible rays, which includes ascorbic acid derivatives, azaindene cadmium salts, organic sulfonic acids, as described in U.S. Pat. Nos. 2,933,390 and 2,937,089.

The adding quantity of these dyes is from $1\times10^{-4}$ mole to 1 mole, and preferably from $1\times10^{-4}$ mole to $1\times10^{-1}$ mole per mole of the silver halide or silver halide-forming component used.

The organic silver salts usable for the heat-developable color light-sensitive material of this invention are described in Japanese Patent Examined Publication Nos. 4924/1968, 26582/1969, 18416/1970, 12700/1970 and 22185/1970; Japanese Patent O.P.I. Publication Nos. 52626/1974, 31728/1977, 13731/1977, 141222/1977, 36224/1978 and 37610/1978; and U.S. Pat. Nos. 3,330,633 and 4,168,980; those including aliphatic carboxylic acid silver salts such as silver laurate, silver myristate, silver palmitate, silver stearate, silver arachidonate, silver behenate, etc.; aromatic carboxylic acid silver salts such as silver benzoate, silver phthalate, etc.; imino group-having silver salts such as silver benzotriazole, silver saccharin, silver phthalazinone, silver phthalimide, etc.; mercapto or thione group-having compound silver salts such as silver 2-mercaptobenzoxazole, silver mercaptoxadiazole, silver mercaptobenzothiazole, silver 2-mercaptobenzimidazole, silver 3-mercaptophenyl-1,2,4-triazole, etc.; and in addition, silver 4-hydroxy-6-methyl-1,3,3a,7-tetrazaindene, silver 5-methyl-7-hydroxy-1,2,3,4,6-pentazaindene, and the like.

Those silver compounds as described in Research Disclosure Nos. 16966 and 16907; and British Patent Nos. 1,590,956 and 1,590,957 may also be used, among which, for example, imino group-having silver salts such as silver benzotriazoles are advantageously usable, the silver benzotriazoles including, e.g., silver alkyl-substituted benzotriazoles such as silver methylbenzotriazole; silver halogen-substituted benzotriazoles such as silver bromobenzotriazole, silver chlorobenzotriazole, etc.; silver amido-substituted benzotriazoles such as silver 5-acetamidobenzotriazole; those compounds described in British Patent Nos. 1,590,956 and 1,590,957, such as silver N-[6-chloro-4-N-(3,5-dichloro-4-hydroxyphenyl)imino-1-oxo-5-methyl-2,5-cyclohexadiene-2-yl]-5-carbamoylbenzotriazole, silver 2-benzotriazole-5-ylazo-4-methoxy-1-naphthol, silver 1-benzotriazole-5-ylazo-2-naphthol, silver N-benzotriazole-5-yl-4-(4-dimethyl-aminophenylazo)benzamido, and the like.

Those nitrobenzotriazoles having the following Formula (VIII) and those benzotriazoles having the following Formula (IX) may also be advantageously used.

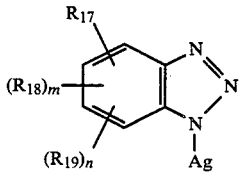

Formula (VIII)

wherein $R_{17}$ represents a nitro group; $R_{18}$ and $R_{19}$ may be either the same as or different from each other and each represents a halogen atom (such as chlorine, bromine or iodine), a hydroxy or sulfo group or a salt thereof (such as sodium, potassium or ammonium salt), a carboxy group or salt thereof (such as sodium, potassium or ammonium salt), a nitro group, a cyano group, or a substitutable carbamoyl, sulfamoyl, alkyl (such as methyl, ethyl, propyl), alkoxy (such as methoxy, ethoxy), aryl (such as phenyl) or amino group; m is an integer of 0, 1 or 2; and n is an integer of 0 or 1. The substituent to the foregoing carbamoyl group includes, e.g., methyl, ethyl, acetyl, etc., that to the sulfamoyl group includes, e.g., methyl, ethyl, acetyl, etc., that to the alkyl group includes, e.g., carboxy, ethoxycarbonyl, etc., that to the aryl group includes, e.g., sulfo, nitro, etc., that to the alkoxy group includes, e.g., carboxy, ethoxycarbonyl, etc., and that to the amino group includes, e.g., acetyl, methanesulfonyl, hydroxy, etc.

The compound having Formula (VIII) is a silver salt of a benzotriazole derivative having at least one nitro group. Examples of the compound include silver 4-nitrobenzotriazole, silver 5-nitrobenzotriazole, silver 5-nitro-6-chlorobenzotriazole, silver 5-nitro-6-methylbenzotriazole, silver 5-nitro-6methoxybenzotriazole, silver 5-nitro-7-phenylbenzotriazole, silver 4-hydroxy-5-nitrobenzotriazole, silver 4-hydroxy-7-nitrobenzotriazole, silver 4-hydroxy-5,7-dinitrobenzotriazole, silver 4-hydroxy-5-nitro-6-chlorobenzotriazole, silver 4-hydroxy5-nitro-6-methylbenzotriazole, silver 4-sulfo-6-nitrobenzotriazole, silver 4-carboxy-6-nitrobenzotriazole, silver 5-carboxy6-nitrobenzotriazole, silver 4-carbamoyl-6-nitrobenzotriazole, silver 4-sulfamoyl-6-nitrobenzotriazole, silver 5-carboxymethyl6-nitrobenzotriazole, silver 5-hydroxycarbonylmethoxy-6-nitrobenzotriazole, silver 5-nitro-7-cyanobenzotriazole, silver 5amino-6-nitrobenzotriazole, silver 5-nitro-7-(p-nitrophenyl)benzotriazole, silver 5,7-dinitro-6-methylbenzotriazole, silver 5,7-dinitro-6-chlorobenzotriazole, silver 5,7-dinitro-6-methoxybenzotriazole, and the like.

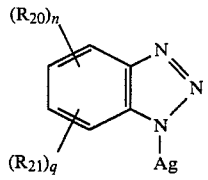

Formula (IX)

wherein $R_{20}$ represents a hydroxy group, a sulfo group or a salt thereof (such as sodium, potassium or ammonium salt), a carboxy group or a salt thereof (such as sodium, potassium or ammonium salt), a substitutable carbamoyl group or a substitutable sulfamoyl group; $R_{21}$ represents a halogen atom (such as chlorine, bromine or iodine), a hydroxy group or a salt thereof (such as sodium, potassium or ammonium salt), a carboxy group or a salt thereof (such as sodium, potassium or ammonium salt), a nitro group, a cyano group, or a substitutable alkyl (such as methyl, ethyl, propyl), aryl (such as phenyl), alkoxy (such as methoxy, ethoxy) or amino group; p is an integer of 1 or 2; and q is an integer of 0 to 2.

The substituent to the carbamoyl group represented by the $R_{20}$ includes, e.g., methyl, ethyl, acetyl, etc., and that to the sulfamoyl group includes, e.g., methyl, ethyl, acetyl, etc. The substituent to the alkyl group represented by the $R_{21}$ includes, e.g., carboxy, ethoxycarbonyl, etc., that to the aryl group includes, e.g., sulfo, nitro, etc., that to the alkoxy group includes, e.g., carboxy, ethoxycarbonyl, etc., and that to the amino group includes, e.g., acetyl, methanesulfonyl, hydroxy, etc.

Examples of the organic silver salts having Formula (IX) include silver 4-hydroxybenzotriazole, silver 5-hydroxybenzotriazole, silver 4-sulfobenzotriazole, silver 5-sulfobenzotriazole, silver benzotriazole-4-sodium sulfonate, silver benzotriazole-5-sodium sulfonate, silver benzotriazole-4-potassium sulfonate, silver benzotriazole-5-potassium sulfonate, silver benzotriazole-4-ammonium sulfonate, silver benzotriazole-5-ammonium sulfonate, silver 4-carboxybenzotriazole, silver 5-carboxybenzotriazole, silver benzotriazole-4-sodium carboxylate, silver benzotriazole-5-sodium carboxylate, silver benzotriazole4-potassium carboxylate, silver benzotriazole-5-potassium carboxylate, silver benzotriazole-4-ammonium carboxylate, silver benzotriazole-5-ammonium carboxylate, silver 5-carbamoylbenzotriazole, silver 4-sulfamoylbenzotriazole, silver 5-carboxy-6-hydroxybenzotriazole, silver 5-carboxy-7-sulfobenzotriazole, silver 4-hydroxy-5-sulfobenzotriazole, silver 4-hydroxy-7-sulfo-benzotriazole, silver 5,6-dicarboxybenzotriazole, silver 4,6-dihydroxybenzotriazole, silver 4-hydroxy-5-chlorobenzotriazole, silver 4-hydroxy-5-methylbenzotriazole, silver hydroxy5-methoxybenzotriazole, silver 4-hydroxy-5-nitrobenzotriazole, silver 4-hydroxy-5-cyanobenzotriazole, silver 4-hydroxy-5-aminobenzotriazole, silver 4-hydroxy-5-acetamidobenzotriazole, silver 4-hydroxy-5-benzenesulfonamidobenzotriazole, silver 4-hydroxy-5-hydroxycarbonylmethoxybenzotriazole, silver 4-hydroxy-5-ethoxycarbonylmethoxybenzotriazole, silver 4-hydroxy-5-carboxymethylbenzotriazole, silver 4-hydroxy-5-ethoxycarbonylmethylbenzotriazole, silver 4-hydroxy-5-phenylbenzotriazole, silver 4-hydroxy-5-(p-nitrophenyl)benzotriazole, silver 4-hydroxy-5-(p-sulfophenyl)benzotriazole, silver 4-sulfo-5-chlorobenzotriazole, silver 4-sulfo-5-methylbenzotriazole, silver 4-sulfo-5-methoxybenzotriazole, silver 4-sulfo-5-cyanobenzotriazole, silver 4-sulfo-5-aminobenzotriazole, silver 4-sulfo-5-acetamidobenzotriazole, silver 4-sulfo-5-benzenesulfonamidobenzotriazole, silver 4-sulfo-5-hydroxycarbonylmethoxybenzotriazole, silver 4-sulfo-5-ethoxycarbonylmethoxybenzotriazole, silver 4-hydroxy5-carboxybenzotriazole, silver 4-sulfo-5-carboxymethylbenzotriazole, silver 4-sulfo-5-ethoxycarbonylmethylbenzotriazole, silver 4-sulfo-5-phenylbenzotriazole, silver 4-sulfo-5-(p-nitrophenyl)benzotriazole, silver 4-sulfo-5-(p-sulfophenyl)benzotriazole, silver 4-sulfo-5-methoxy-6-chlorobenzotriazole, silver 4-sulfo-5-chloro-6-carboxybenzotriazole, silver 4-carboxy-5-chlorobenzotriazole, silver 4-carboxy-5-methylbenzotriazole, silver 4-carboxy-5-nitrobenzotriazole, silver 4-carboxy-5-aminobenzotriazole, silver 4-carboxy-5-methoxybenzotriazole, silver 4-carboxy-5-acetamidobenzotriazole, silver 4-carboxy-5-ethoxycarbonylmethoxybenzotriazole, silver 4-carboxy-5-carboxymethylbenzotriazole, silver 4-carboxy-5-phenylbenzotriazole, silver 4-carboxy-5-(p-nitrophenyl)benzotriazole, silver 4-carboxy-5-methyl-7-sulfobenzotriazole, and the like. These compounds may be used alone or in a mixture of two or more of them.

The preparation of the organic silver salt used in the present invention will be described hereinafter, but the organic silver salt may be used in the isolated form to be dispersed by appropriate means into a binder or may also be prepared in an appropriate binder and used as it is without isolation.

The use quantity of the organic silver salt is from 0.05 g to 10.0 g, and preferably from 0.2 g to 2.0 g per square meter of the support used.

Reducing agents usable for the heat-developable color light-sensitive material of this invention are those known color developing agents and precursors thereof as described in U.S. Pat. Nos. 3,531,286, 3,761,270 and 3,764,328; Research Disclosure Nos. 12146, 15108 and 15127; and Japanese Patent O.P.I. Publication No. 27132/1981, which include p-phenylenediamine-type and p-aminophenol-type developing agents, phosphoroamidophenol-type and sulfonamidophenol-type developing agents, and hydrazone-type developing agents. Further, the particularly preferred ones are those p-(N,N-dialkylaminophenyl)sulfamic acid developing agents as described in Japanese Patent O.P.I. Publication Nos. 146133/1981 and 116740/1984.

These reducing agents may be used alone or n combination of two or more of them. The use quantity of these reducing agents, although it depends on the organic acid silver salt and light-sensitive silver salt used and other additives used, may be normally from 0.05 mole to 10 moles, and preferably from 0.1 mole to 3 moles per mole of the organic silver salt used.

The heat-developable color light-sensitive material of this invention may, if necessary, contain various additives including development accelerators, toning agents, antifoggants, stabilizers, and the like, in addition to the above-mentioned components. The development accelerator includes, for example, those alkaline releasing agents as described in U.S. Pat. Nos. 3,220,840, 3,531,285, 4,012,260, 4,060,420, 4,088,496 and 4,207,392; and Research Disclosure Nos. 15733, 15734 and 15776; those organic acids as described in Japanese Patent Examined Publication No. 12700/1970; those nonaqueous polar solvent compounds having a —CO—, —$SO_2$— or —SO— group as described in U.S. Pat. No. 3,667,959; those melt formers as described in U.S. Pat. No. 3,438,776; and those polyalkylene glycols as described in U.S. Pat. No. 3,666,477 and Japanese Patent O.P.I. Publication No. 19525/1976. The toning agent includes those compounds as described in Japanese Patent O.P.I. Publication Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 156524/1979, 156525/1979, 156526/1979, 4060/1980, 4061/1980 and 32015/1980; West German Patent Nos. 2,140,406, 2,147,063 and 2,220,618; and U.S. Pat. Nos. 3,080,254, 3,847,612, 3,782,941, 3,994,732, 4,123,282 and 4,201,582, the compounds including phthalazinone, phthalimide, pyrazolone, quinazoline, N-hydroxynaphthalimide, benzoxazine, naphthoxazine, 2,3-dihydrophthalazinone, 2,3-dihydro-1,3-oxazine-2,4-dione, oxypyridine, aminopyridine, hydroxyquinoline, aminoquinoline, isocarbostyrylsulfonamide, 2H-1,3-benzothiazine-2,4-(3H)dione, benzotriazine, mercaptotriazole, dimercaptotetrazapentalene, phthalic acid, naphthalic acid, phthalamic acid, and the like. And the toning agent also includes a mixture of one or more of these compounds with an imidazole compound; a mixture of at least one of such acids as the phthalic acid, naphthalic acid, etc., or the acid anhydride thereof, with a phthalazine compound; and a combination of phthalazine with maleic acid, itaconic acid, quinolic acid, gentistic acid, or the like. Further, those 3-amino-5-mercapto-1,2,4-triazoles and 3-acylamino-5-mercapto-1,2,4-triazoles as described in Japanese Patent O.P.I. Publication Nos. 189628/1983 and 193460/1983 may also be effectively used as the toning agent.

The antifoggant includes those compounds as described in Japanese Patent Examined Publication No. 11113/1972; Japanese Patent O.P.I. Publication Nos. 90118/1974, 10724/1974, 97613/1974, 101019/1975, 130720/1974, 123331/1975, 47419/1976, 57435/1976, 78227/1976, 104338/1976, 19825/1978, 20923/1978, 50725/1976, 3223/1976, 42529/1976, 81124/1976, 51821/1979 and 93149/1980; British Pat. No. 1,455,271; U.S. Pat. Nos. 3,885,968, 3,700,457, 4,137,079 and 4,138,265; and West German Pat. No. 2,617,907, the compound including mercuric salts, oxidizing agents (such as N-halogenoacetamide, N-halogenosuccinic acid imide, perchloric acid and the salts thereof, inorganic peroxides, persulfates, etc.), acids and the salts thereof (such as sulfinic acid, lithium laurate, rosin, diterpenic acid, thiosulfonic acid, etc.), sulfur-containing compounds (such as mercapto compound-releasing compounds, thiouracil, disulfides, simple sulfur, mercapto-1,2,4-triazole, thiazolinethione, polysulfide compounds, etc.), and other compounds such as oxazoline, 1,2,4-triazole, phthalimide, and the like.

As the stabilizer, particularly anti-print-out agents for post-treatment may be used which includes those halogenated hydrocarbons as described in Japanese Patent O.P.I. Publication Nos. 45228/1973, 119624/1975, 120328/1975 and 46020/1978, such as tetrabromoethane, tribromoethanol, 2-bromo-2-tolylacetamide, 2-bromo-2-tolylsulfonylacetamide, 2-tribromomethylsulfonylbenzothiazole, 2,4-bis(tribromomethyl)-6-methyltriazine, and the like.

For stabilizing the heat-developable light-sensitive material of the invention, those sulfur-containing compounds as in Japanese Patent Examined Publication No. 5393/1971; and Japanese Patent O.P.I. Publication Nos. 54329/1975 and 77034/1975 may be used for the post-treatment thereof.

Further, the heat-developable light-sensitive material of this invention may contain any of those isothiuronium-type stabilizer precursors as described in U.S. Pat. Nos. 3,301,678, 3,506,444, 3,824,103 and 3,844,788 and those activator stabilizer precursors as described in U.S. Pat. Nos. 3,669,670, 4,012,260 and 4,060,420.

The heat-developable color light-sensitive material of the present invention may further contain, if necessary, various other additives such as a spectrally sensitizing dye, antihalation dye, brightening agent, antistatic agent, plasticizer, coating aid, and the like, in addition to the above-mentioned components.

The foregoing various components-containing layer and other layers of this invention may be coated on a support selected from a large variety of materials. The support material usable in this invention includes plastic films such as cellulose nitrate film, cellulose ester film, polyvinylacetal film, polyethylene film, polyethylene terephthalate film, polycarbonate film, etc.; glass, paper, metal such as aluminum, and the like. Baryta paper, resin-coated paper and water-proof paper also may be used as the support.

The heat-developable color light-sensitive material of this invention may be provided with various layers such as an overcoat polymer layer, subbing layer, backing layer, interlayer, filter layer, etc., in addition to the light-sensitive layer.

The heat-developable color light-sensitive material is capable of forming a dye image by being subjected to an imagewise exposure and heat treatment, and may be designed to be also capable of transferring the formed dye image onto an imagereceiving layer provided therefor by the aid of a solvent such as methanol, or of thermally transferring the image by use of a thermal solvent such as methyl anisate, which is fused by heating. To the light-sensitive material may also be applied the heat-transfer system disclosed in British Pat. No. 1,590,957.

The heat-developable color light-sensitive material of the present invention (hereinafter referred to as the lightsensitive element of this invention), when applied to the color heat-diffusion transfer process which is such that, by being exposed imagewise and heat-developed, a dye-donating material forms the corresponding imagewise distribution of a heat-transferable dye, and at least part of the imagewise-distributed dye is thermally transferred onto an image-receiving layer having superposed relation with the light-sensitive element of this invention, thereby forming an image density-improved highdensity image on the image-receiving layer.

The image-receiving layer should have a function of accepting the dye released or formed by heat development, and is desirable to be formed of a mordant used for light-sensitive materials of the dye diffusion transfer type and a heat-resistant organic high-molecular material having a glass transition temperature of from 40° C. to 250° C. as described in Japanese Patent O.P.I. Publication No. 207250/1982.

Examples of the above-mentioned mordant include nitrogencontaining secondary and tertiary amines, nitrogen-containing heterocyclic compounds, quaternary cationic compounds of these materials; those vinylpyridine polymers and vinylpyridinium cationic polymers as disclosed in U.S. Pat. Nos. 2,548,564, 2,484,430, 3,148,061 and 3,756,814; those dialkylamino groupcontaining polymers as disclosed in U.S. Pat. No. 2,675,316; those aminoguanidine derivatives as disclosed in U.S. Pat. No. 2,882,156; those mordants cross-linkable with gelatin and the like as disclosed in U.S. Pat. Nos. 3,625,694 and 3,859,096, British Pat. Nos. 1,277,453 and 2,011,012; those aqueous sol-type mordants as disclosed in U.S. Pat. Nos. 3,958,995, 2,721,852 and 2,798,063; those water-insoluble mordants as disclosed in Japanese Patent O.P.I. Publication No. 61228/1975; and those various mordants as disclosed in U.S. Pat. No. 3,788,855, West German OLS Patent No. 2,843,320, Japanese Patent O.P.I. Publication Nos. 30328/1978, 155528/1977, 125/1978, 1024/1978, 74430/1979, 124726/1979 and 22766/1980, U.S. Pat. Nos. 3,642,482 3,488,706, 3,557,066, 3,271,147 and 3,271,148, Japanese Patent Examined Publication Nos. 29418/1980, 36414/1981 and 12139/1982, and Research Disclosure No. 12045 (1974).

Particularly useful mordants are those ammonium salt-containing polymers described in U.S. Pat. No. 3,709,690, an example of which is polystyrene-co-N,N,N-tri-n-hexyl-N-vinylbenzylammonium chloride. The proportion of the styrene to the vinylbenzylammonium chloride is between 1 to 4 and 4 to 1, and preferably 1 to 1.

A typical image-receiving layer for the dye diffusion transfer can be obtained by coating a mixture of an ammonium salt-containing polymer with gelatin on a support. The dye image transfer from the heat-developable light-sensitive layer onto the image-receiving layer may be carried out by use of an image transfer solvent, the solvent including low-boiling solvents such as methanol, ethyl acetate, diisobutyl ketone, etc., and high-boiling solvents such as tri-n-cresyl phosphate, trinnonyl phosphate, di-n-butyl phthalate, etc. For the incorporation of the high-boiling solvent, an appropriate emulsifying agent is used to emulsify the solvent into gelatin for the formation of an image-receiving layer.

Examples of the foregoing heat-resistant organic high-molecular material include polystyrenes having a molecular weight of from 2,000 to 85,000, polystyrene derivatives with a substituent having not less than 4 carbon atoms, polyvinylcyclohexane, polydivinylbenzene, polyvinylpyrolidone, polyvinylcarbazole, polyallylbenzene, polyvinyl alcohol, polyacetals such as polyvinylformal and polyvinylbutyral, etc., polyvinyl chloride, chlorinated polyethylene, polyethylene trichlorofluoride, polyacrylonitrile, poly-N,N-dimethylallylamide, polyacrylates having p-cyanophenyl, pentachlorophenyl, or 2,4-dichlorophenyl group, polyacryl chloroacrylate, polymethyl methacrylate, polyethyl methacrylate, polypropyl methacrylate, polyisopropyl methacrylate, polyisobutyl methacrylate, poly-tert-butyl methacrylate, polycyclohexyl methacrylate, polyethylene-glycol dimethacrylate, poly-2-cyanoethyl methacrylate, polyesters such as polyethylene terephthalate, polysulfone, polycarbonates such as bisphenol-A polycarbonate, polyanhydrides, polyamides, and cellulose acetates; and also include those useful synthetic polymers having a glass transition point of not more than 40° C. as described in the "Polymer Handbook" 2nd ed. (edited by J. Brandrup and E. H. Immergut) published by John Wiley & Sons. These high-molecular materials may be used alone or in combination of a plurality thereof to be in the form of a copolymer.

The particularly useful polymers are cellulose acetates such as cellulose triacetate, cellulose diacetate, etc., polyamides such as the combination of heptamethylenediamine with terephthalic acid, the combination of fluorenedipropylamine with adipic acid, the combination of hexamethylenediamine with diphenic acid, the combination of hexamethylenediamine with isophthalic acid, etc., polyesters such as the combination of diethylene glycol with diphenylcarboxylic acid, the combination of bis-p-carboxyphenoxybutane with ethylene glycol, etc., polyethylene terephthalate, polyvinyl chloride and polycarbonate. These polymers are allowed to be reformed ones. For example, those polyethylene terephthalates produced by using cyclohexanedimethanol, isophthalic acid, methoxy-polyethylene glycol or 1,2-dicarbomethoxy-4-benzenesulfonic acid, etc., as the reforming agent, also are useful.

The above polymers may be used for the formation of an image-receiving layer in the following manner: The polymer is dissolved into an appropriate solvent to be coated as an imagereceiving layer on a support; a film-form image-receiving layer comprising the polymer is laminated on a support; or a member (e.g., film form) comprising the polymer by itself, without being coated on a support, constitutes an image-receiving layer (the layer itself functions also as a support).

Further, the image-receiving layer may be of the construction that the image-receiving layer is sandwiched between a titanium dioxide-dispersed gelatin opaque layer (reflective layer) and a transparent support. This opaque layer enables viewing the transferred dye image from the transparent support side, whereby a reflective-type color image can be obtained.

Effect of the Invention

The present invention, as will be apparent from the hereinafter described examples, has an effect of preventing the diffusion of the dye-donating material as well as to reduce the color-crossover phenomenon. This invention improves also the transferability of the dye; this is considered due to the fact that the presence of a hardening agent causes the crosslinkage of the binder therewith to thereby reduce the interaction of the binder with the dye. In addition, this invention has also a good effect of improving the scratch resistance of the photograhic component layers.

EXAMPLES

The following are examples of the present invention. The embodiment of the invention is not limited by the following examples. In addition, the term "part(s)" used hereinafter represents "part(s) by weight," unless otherwise stated.

EXAMPLE 1

On a support (1) were provided layers containing lightsensitive silver halide (2) and (2'), organic silver salt (3), reducing agent (4), dye-donating materials (5) and (5'), aqueous binder (6), hardening agent (7), thermal solvent (8), surface active agent (9) and development accelerator (10), whereby a diffusion transfer-type multi-layer heat-developable color light-sensitive element sample was prepared.

(1) Support

Subbed 100 μm-thick transparent polyethylene terephthalate film.

FIRST LAYER (2) Light-sensitive silver halide (silver equivalent 0.18 g/m$^2$):

A sensitized-by-a-sulfur-sensitizer gelatino-silver iodide with an average particle size of 0.1 μm (halogen molar ratio Br:I=97:3), to which are added the following Cyanine Dye (A), 4-hydroxy-6-methyl-1,3,3a,7-tetrazaindene, and 1-phenyl-5-mercaptotetrazole.

Cyanine Dye (A)

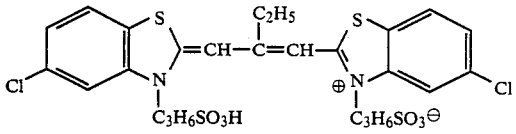

(3) Organic silver salt (silver equivalent 0.6 g/m$^2$):

A liquid prepared by the equimolar reaction of 4-sulfobenzotriazole with silver nitrate in an aqueous poly(4-vinylpyridine) solution and by adding, after the reaction, sodium hydroxide to adjust the pH to 6.0.

(4) Reducing agent (0.8g/m$^2$)

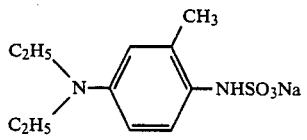

(5) Dye-donating compound (1.1 g/m$^2$)

Exemplified Compound (2)

(6) Hydrophilic binder (4 g/m$^2$)

A mixture of 3 parts of gelatin and 7 parts of poly(4-vinylpyrolidone), which is used in organic silver salt (3).

(7) Hardening agent

A hardening agent prepared in the manner that the product of the reaction of 4 parts of tetra(vinylsulfonylmethyl)methane with 3 parts of taurine is rendered an aqueous solution in accordance with the method disclosed in Japanese Patent O.P.I. Publication No. 142330/1980. [Tetra(vinylsulfonylmethyl)methane equivalent 8 mg/m$^2$]

| | |
|---|---|
| (8) Thermal solvent: | |
| Polyethylene glycol 300 (a product of Tokyl Chemical Industry Co., Ltd.) | 1.0 g/m$^2$ |
| Pentaerythritol | 2.0 g/m$^2$ |
| (9) Surface active agent (20 mg/m$^2$): | |

$$H(CF_2CF_2)_mCH_2OCOCH(H(CF_2CF_2)_nCH_2OCOCH_2)-SO_3N_a$$

$$\left(\begin{matrix} m=2 \\ n=2 \end{matrix}\right\} 66\%,\ \left.\begin{matrix} m=2 \\ n=3 \end{matrix}\right\} 31\%,\ \left.\begin{matrix} m=3 \\ n=3 \end{matrix}\right\} 3\%\ \Bigg)$$

(10) Development accelerator (0.03 g/m$^2$)

4-allyl-3-amino-5-mercapto-1,2,4-triazole

SECOND LAYER (2') Light-sensitive silver halide (silver equivalent 0.15 g/m$^2$)

A light-sensitive silver halide prepared in the same manner as in (2) except that the Cyanine Dye (A) is replaced by the following Cyanine Dye (B):

Cyanine Dye (B)

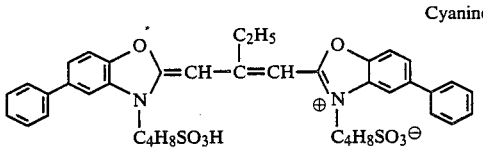

(5') Dye-donating compound (1.3 g/m$^2$)

Exemplified Compound (5)

The other additives used are the same as those in the first layer.

On the other hand, an image-receiving layer was formed by coating polyvinyl chloride (n≈1,100, a product of Wako Junyaku K. K.) in the form of a tetrahydrofuran solution on a photographic baryta paper support so that its dry thickness is 15 μm.

The thus prepared photographic element sample was exposed to a green light and red light by use of Wratten Filters No. 99 and No. 29, manufactured by Eastman Kodak Company. After that the element was superposed upon the above-prepared image-receiving layer, heating for one minute at 160° C., and then immediately both layers were peeled apart.

As a comparative example, a sample prepared in the same manner but containing no hardening agent (7) at all was also subjected to the same test as that described above.

The densities of the dye images on both image-receiving layers are as given in Table 1.

TABLE 1

| Sample | Area exposed to green: Density to green light | Area exposed to green: Density to red light | Area exposed to red: Density to red light | Area exposed to red: Density to green light |
|---|---|---|---|---|
| Invention | 1.26 | 0.19 | 0.81 | 0.20 |
| Comparative | 1.20 | 0.45 | 0.79 | 0.34 |

Note:
The density to green light and density to red light in the above table are the densities obtained by measuring with lights centering on 546 nm and 644 nm, respectively.

As is apparent from Table 1, in the area exposed to the green light; i.e., in the magenta dye image area, the comparative sample shows a color crossover due to the mixing of the cyan dye into the magenta dye, whereas the sample of this invention shows a much smaller color crossover. The similar effect can be seen in the area exposed to the red light.

EXAMPLE 2

In the same manner as in Example-1, on a support (1) were provided the following first and second layers, whereby a diffusion transfer-type multi-layer heat-developable color light-sensitive element was prepared.

First layer

The first layer is of similar components to those of the second layer of the sample of Example 1, but differs in that the thermal solvent polyethylene glycol used in Example 1 is replaced by dimethyl urea and 11 mg/m$^2$ of the following hardening agent (H) is used.

Hardening agent (H)

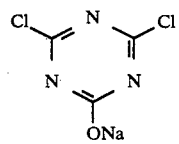

Second layer

The second layer is of similar components to those of the first layer of the sample of Example 1, but differs in that the following Cyanine Dye (C) is used for the light-sensitive silver halide and the following Dye-Donating Compound (Y) is used. The thermal solvent and hardening agent are the same as those of the first layer in Example 1.

Cyanine Dye (C)

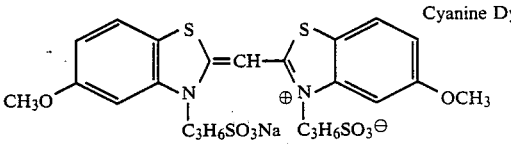

DYE-DONATING COMPOUND (Y)

Exemplified Compound (12)

In the same manner as in Example 1, Wratten Filters No. 47B and No. 99 were used in exposing the obtained sample to blue and green lights, and after that the same processing as in Example 1 was performed.

As a comparative example, a sample prepared like manner but containing no Hardening Agent (H) at all also was tested in the same manner as the above.

The densities of the images of both samples formed on the respective image-receiving layers are as given in Table 2.

TABLE 2

| Sample | Area exposed to blue: Density to blue light | Area exposed to blue: Density to Green light | Area exposed to green: Density to Green light | Area exposed to green: Density to blue light |
|---|---|---|---|---|
| Invention | 1.27 | 0.21 | 1.10 | 0.29 |
| Comparative | 1.27 | 0.43 | 1.04 | 0.40 |

Note:
The density to blue light in the table is the density measured with light centering on 436 nm.

Also in Table 2, it is apparent that the sample of this invention in Example 2, which contains Hardening Agent (H), has an effect of restraining the color cross-over as in Example 1.

What is claimed is:

1. In a heat-developable color light-sensitive material comprising a support having thereon at least two light-sensitive layers each comprising a light-sensitive silver halide, organic silver salt, dye-donating material capable of releasing or forming a diffusible dye by heat development, reducing agent, and hydrophilic binder, said at least two light-sensitive layers differing from each other in the color sensitivity of said light-sensitive silver halide and in the hue of said diffusible dye, said heat-developable color light-sensitive material, wherein at least one of said light-sensitive layer(s) containing said dye-donating materials is homogeneously hardened with a hardening agent for said hydrophilic binder.

2. A heat-developable color light-sensitive material as claimed in claim 1, wherein said light-sensitive layers are a blue-sensitive layer, a green-sensitive layer and a red-sensitive layer.

3. A heat-developable color light-sensitive material as claimed in claim 2, wherein every one of said blue-, green- and red-sensitive layers is hardened with a hardening agent for hardening a hydrophilic binder.

4. A heat-developable color light-sensitive material as claimed in claim 1, wherein said light-sensitive layers are hardened by adding therein with the hardening agent in a quantity of from 0.1 to 500 mg per gram of the hydrophilic binder.

5. A heat-developable color light-sensitive material as claimed in claim 1, wherein the quantity of said hydrophilic binder used in each of said light-sensitive layers hardened with said hardening agent is from 1/10 to 10 parts by weight per part by weight of an organic silver salt.

6. A heat-developable color light-sensitive material as claimed in claim 1, wherein the quantity of the dye-donating materials used is from 0.01 to 10 mole per mole of the organic silver salt.

7. A heat-developable color light-sensitive material as claimed in claim 2, wherein the light-sensitive layers adjacent respectively to the blue-, green- and red-sensitive layers contain dye-donating materials capable of releasing or forming the dyes having different hues from each other.

8. A heat-developable color light-sensitive material as claimed in claim 1, wherein the hardening agent for hardening the hydrophilic binders is selected from those compounds having in the molecules thereof at least two vinyl-sulfonyl groups.

9. The light-sensitive material of claim 8 having the formula $$CH_2{=}CHSO_2CH_2OCH_2SO_2CH{=}CH_2$$

or $$CH_2{-}CHSO_2CH_2CH_2OCH_2CH_2SO_2CH{=}CH_2.$$

10. A heat-developable color light-sensitive material as claimed in claim 1, wherein gelatin is contained as said hydrophilic binder.

11. A heat-developable color light-sensitive material as claimed in claim 10, wherein the hydrophilic binder is of a gelatin-polyvinyl pyrolidone type and/or a gelatin-polyvinyl alcohol type.

12. A heat-developable color light-sensitive material as claimed in claim 1, wherein said dye-donating materials have the following Formula [II];

$$A{-}B \qquad \text{Formula [II]}$$

wherein A represents a hydrophobic group-having coupler residue which does not contain a sulfo carboxyl or sulfonamido group; and B represents a group that can be split off from the coupler residue during a coupling reaction, the group having sulfo, carboxyl or sulfamoyl group, or a group substituted by any of these hydrophilic groups.

13. A heat-developable color light-sensitive material as claimed in claim 12, wherein said dye-donating materials having Formula [I] are those couplers capable of forming a sublimable or volatile dye by the reaction thereof with the oxidized product of a color developing agent.

14. The light-sensitive material of claim 8 having the formula $$CH_2{=}CHSO_2CH_2\underset{\underset{OH}{|}}{C}HCH_2SO_2CH{=}CH_2$$

15. The light-sensitive material of claim 8 wherein said hardening agent $$H_2C{=}CHSO_2CH_2SO_2CH{=}CH_2, \qquad (1)$$

$$H_2C{=}CHSO_2CH_2CH_2CH_2SO_2CH{=}CH_2 \qquad (3)$$

$$CH_2{=}CHSO_2CH_2\underset{\underset{OH}{|}}{C}HCH_2\underset{\underset{OH}{|}}{C}HCH_2SO_2CH{=}CH_2, \qquad (7)$$

$$CH_2{=}CHSO_2CH_2\underset{\underset{OH}{|}}{C}HCH_2OCH_2\underset{\underset{OH}{|}}{C}HCH_2SO_2CH{=}CH_2, \qquad (8)$$

$$CH_2{=}CHSO_2CH_2CONHNHCOCH_2SO_2CH{=}CH_2, \qquad (9)$$

$$CH_2{=}CHSO_2CH_2CONHCH_2NHCOCH_2SO_2CH{=}CH_2, \qquad (10)$$

$$CH_2{=}CHSO_2CH_2CONHCH_2CH_2NHCOCH_2SO_2CH{=}CH_2, \qquad (11)$$

$$CH_2{=}CHSO_2CH_2CONHCH_2CH_2CH_2NHCOCH_2SO_2CH{=}CH_2, \qquad (12)$$

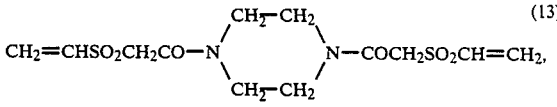

(13)

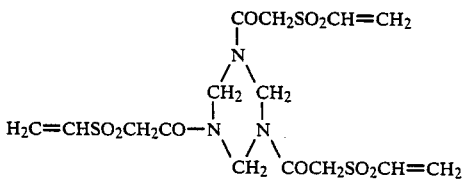

(14)

or

-continued $$\begin{array}{ccc} CH_2{=}CHSO_2C_2H_4CONH & & NHCOC_2H_4SO_2CH{=}CH_2 \\ & \diagdown\ \ \diagup & \\ & CHCH_2CH & \\ & \diagup\ \ \diagdown & \\ CH_2{=}CHSO_2C_2H_4CONH & & NHCOC_2H_4SO_2CH{=}CH_2 \end{array} \quad (15)$$

16. The light-sensitive material of claim 8 wherein said hardening agent is $$\begin{array}{l} CH_2{=}CH{-}SO_2CH_2CH_2CONH \\ \qquad\qquad\qquad\qquad\qquad\qquad \diagdown \\ \qquad\qquad\qquad\qquad\qquad\qquad\quad CH_2, \\ \qquad\qquad\qquad\qquad\qquad\qquad \diagup \\ CH_2{=}CH{-}SO_2CH_2CH_2CONH \end{array} \quad (16)$$

$$\begin{array}{l} CH_2{=}CH{-}SO_2CH_2CH_2CONH{-}CH_2 \\ \qquad\qquad\qquad\qquad\qquad\qquad\qquad\qquad | \\ CH_2{=}CH{-}SO_2CH_2CH_2CONH{-}CH_2, \end{array} \quad (17)$$

$$\begin{array}{l} \qquad\qquad\qquad\qquad\qquad\qquad CH_3 \\ \qquad\qquad\qquad\qquad\qquad\qquad | \\ CH_2{=}CHSO_2CH_2CHCONH \\ \qquad\qquad\qquad\qquad\qquad\qquad\qquad\qquad \diagdown \\ \qquad\qquad\qquad\qquad\qquad\qquad\qquad\qquad\quad CH_2, \\ \qquad\qquad\qquad\qquad\qquad\qquad\qquad\qquad \diagup \\ CH_2{=}CHSO_2CH_2CHCONH \\ \qquad\qquad\qquad\qquad\qquad\qquad | \\ \qquad\qquad\qquad\qquad\qquad\qquad CH_3 \end{array} \quad (18)$$

$$\begin{array}{l} \qquad\qquad\qquad\qquad\qquad\qquad CH_3 \\ \qquad\qquad\qquad\qquad\qquad\qquad | \\ CH_2{=}CHSO_2CH_2CHCONH \\ \qquad\qquad\qquad\qquad\qquad\qquad\qquad\qquad \diagdown \\ \qquad\qquad\qquad\qquad\qquad\qquad\qquad\qquad (CH_2)_3, \\ \qquad\qquad\qquad\qquad\qquad\qquad\qquad\qquad \diagup \\ CH_2{=}CHSO_2CH_2CHCONH \\ \qquad\qquad\qquad\qquad\qquad\qquad | \\ \qquad\qquad\qquad\qquad\qquad\qquad CH_3 \end{array} \quad (19)$$

$$\begin{array}{l} CH_2{=}CHSO_2CH_2{-}CH{-}CH_2SO_2CH{=}CH_2 \\ \qquad\qquad\qquad\qquad\qquad\qquad | \\ \qquad\qquad\qquad\qquad\qquad\qquad SO_2CH{=}CH_2 \end{array} \quad (20)$$

or

-continued $$\begin{array}{l} (CH_2{=}CHSO_2)_2CH{-}CH{-}CH(SO_2CH{=}CH_2)_2 \\ \qquad\qquad\qquad\qquad\qquad\qquad | \\ \qquad\qquad\qquad\qquad\qquad\qquad SO_2CH{=}CH_2 \end{array} \quad (22)$$

17. The light-sensitive material of claim 8 wherein said hardening agent is $(CH_2{=}CHSO_2CH_2)_3CCH_2SO_2CH_2CH_2NH$ 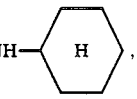 , (26)

$[(CH_2{=}CHSO_2CH_2)_3CCH_2SO_2CH_2CH_2SCH_2]_2CO,$ (27)

$(CH_2{=}CHSO_2CH_2)_3CCH_2SO_2CH_2CH_2O$ 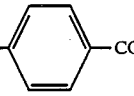 $COOH,$ (28)

$(CH_2{=}CHSO_2CH_2)_3CCH_2SO_2CH_2CH_2{-}N$ 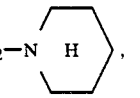 , (29)

$(CH_2{=}CHSO_2CH_2)_3CCH_2SO_2CH_2CH_2S$ 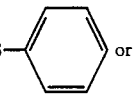 or (30)

$C[CH_2{-}SO_2{-}CH{=}CH_2]_4.$ (31)

18. The light-sensitive material of claim 8 wherein said hardening agent is $$\begin{array}{l} \qquad\qquad\qquad\qquad\qquad\qquad CH_3 \qquad\qquad\qquad CH_3 \\ CH_2{=}CHSO_2CH{-}C{-}CH_2{-}CH_2{-}C{-}CH_2SO_2CH{=}CH_2, \\ \qquad\qquad\qquad\qquad\qquad\qquad SO_2CH{=}CH_2 \qquad SO_2CH{=}CH_2 \end{array} \quad (21)$$

$(CH_2{=}CHSO_2CH_2)_3C{-}CH_2SO_2CH_2CH_2SCH_2COOH$ or (24)

$(CH_2{=}CHSO_2CH_2)_3C{-}CH_2SO_2CH_2CH_2NHCH_2CH{-}_2SO_3H.$ (25)

* * * * *